US006367127B1

(12) United States Patent
Lee

(10) Patent No.: US 6,367,127 B1
(45) Date of Patent: Apr. 9, 2002

(54) TIE CLIP FOR NECKTIE

(76) Inventor: Hsien-Ching Lee, 5Fl., No. 66, Chung Cheng Rd., Hsinchuang, Taipei County (TW)

( * ) Notice: Subject to any disclaimer, the term of this patent is extended or adjusted under 35 U.S.C. 154(b) by 0 days.

(21) Appl. No.: 09/578,344

(22) Filed: May 24, 2000

(51) Int. Cl.[7] ..... A41D 25/02

(52) U.S. Cl. ..... 24/66.3; 2/153; 24/65; 24/66.4

(58) Field of Search ..... 24/65, 49.1, 66.3, 24/66.4, 66.8; 2/153, 916, 154, 148, 144, 145

(56) References Cited

U.S. PATENT DOCUMENTS 2,907,045 A * 10/1959 O'Reilly ..... 2/153
3,220,015 A * 11/1965 Kanter et al. ..... 24/65 X
3,222,684 A * 12/1965 Kanter et al. ..... 24/65 X
3,336,600 A * 8/1967 Kanter et al. ..... 2/153
3,513,483 A * 5/1970 Kanter et al. ..... 2/153
3,755,821 A * 9/1973 Tellone ..... 2/153
4,059,853 A * 11/1977 Girdler ..... 24/66.4
4,337,539 A * 7/1982 Najarian ..... 2/153
5,035,002 A * 7/1991 Knight, Jr. ..... 2/153
5,216,757 A * 6/1993 Dorkin ..... 2/152.1

* cited by examiner

*Primary Examiner*—Robert J. Sandy
(74) *Attorney, Agent, or Firm*—Pro-Techtor International Services

(57) ABSTRACT

A tie clip is constructed to include a shell, and a clip for securing the shell to a loose knot in a necktie, the shell having a flat body and two symmetrical wings turned backwards and then inwards toward each other from two opposite sides of the body, the wings being spaced from each other by a gap and defining with the body a receiving space having a narrow bottom mouth for receiving the knot of the necktie, the clip including a base frame fixedly fastened to the body of the shell inside the receiving space, the base frame having an upper clamping arm and two lower clamping arms, and a hook coupled to the upper clamping arm and the two lower clamping arms of the mounting frame and turned between a first position where the shell is allowed to be attached to the knot of the necktie, and a second position where the hook is hooked on the knot of the necktie to secure the shell to the necktie.

6 Claims, 10 Drawing Sheets

TIE CLIP FOR NECKTIE

BACKGROUND OF THE INVENTION

The present invention relates to a tie clip, and more particularly to such a tie clip, which can conveniently be fastened to the knot of a necktie being fastened to the collar of the user's shirt to decorate the knot and protect the knot against contamination, enabling the necktie to be quickly adjusted to the desired length.

A necktie is a garment accessory worn round the neck and tied in front. However, it is complicated to wear a necktie round the neck. One may have to give several trials before adjusting the necktie to the best-fit length. Further, frequently tying a necktie in a knot may cause the necktie permanently wrinkled, and the necktie tends to be contaminated when tying the necktie in a knot.

SUMMARY OF THE INVENTION

The present invention has been accomplished to provide a tie clip, which eliminates the aforesaid problem. It is one object of the present invention to provide a tie clip for necktie, which decorates the tie of a necktie. It is another object of the present invention to provide a tie clip for necktie, which protects the knot of the necktie against contamination. It is still another object of the present invention to provide a tie clip for necktie, which enables the user to adjust the length of the necktie easily and quickly. According to the present invention, the tie clip comprises a shell, and a clip for securing the shell to the knot of a necktie, the shell having a flat body and two symmetrical wings turned backwards and then inwards toward each other from two opposite sides of the body, the wings being spaced from each other by a gap and defining with the body a receiving space having a narrow bottom mouth for receiving the knot of the necktie, the clip comprising a base frame fixedly fastened to the body of the shell inside the receiving space, the base frame having an upper clamping arm and two lower clamping arms, and a hook coupled to the upper clamping arm and the two lower clamping arms of the mounting frame and turned between a first position where the shell is allowed to be attached to the knot of the necktie, and a second position where the hook is hooked on the knot of the necktie to secure the shell to the necktie. The knot of the necktie is maintained in a loose manner, so that the user can conveniently adjust the necktie to the desired length.

DETAILED DESCRIPTION OF THE PREFERRED EMBODIMENT

Figure 1:
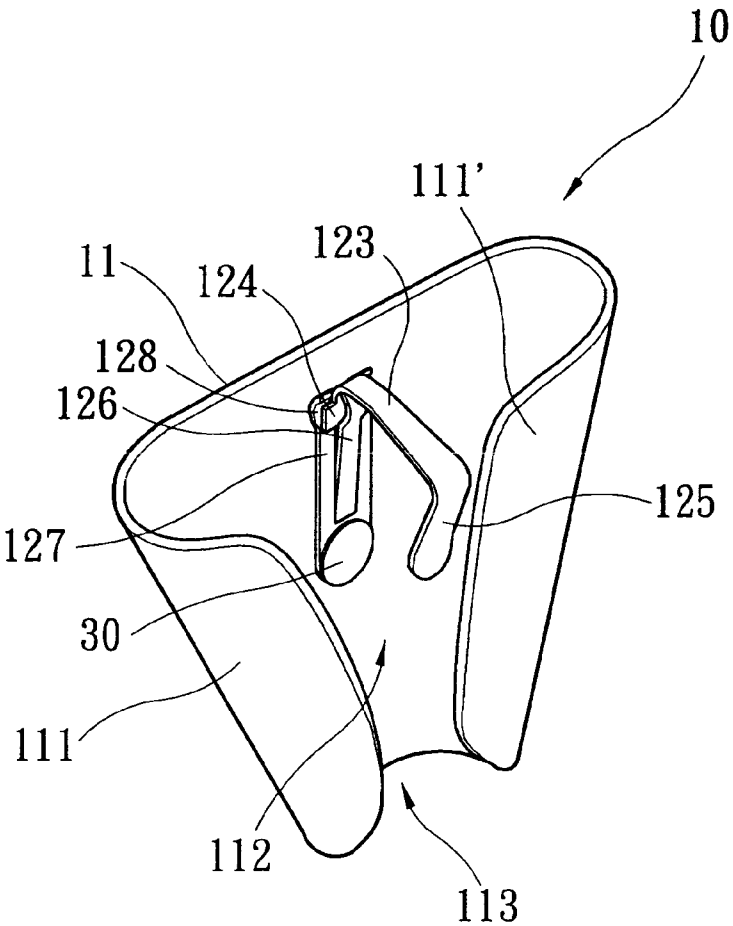
FIG. 1 is a perspective view of a tie clip according to one embodiment of the present invention.
Figure 2:
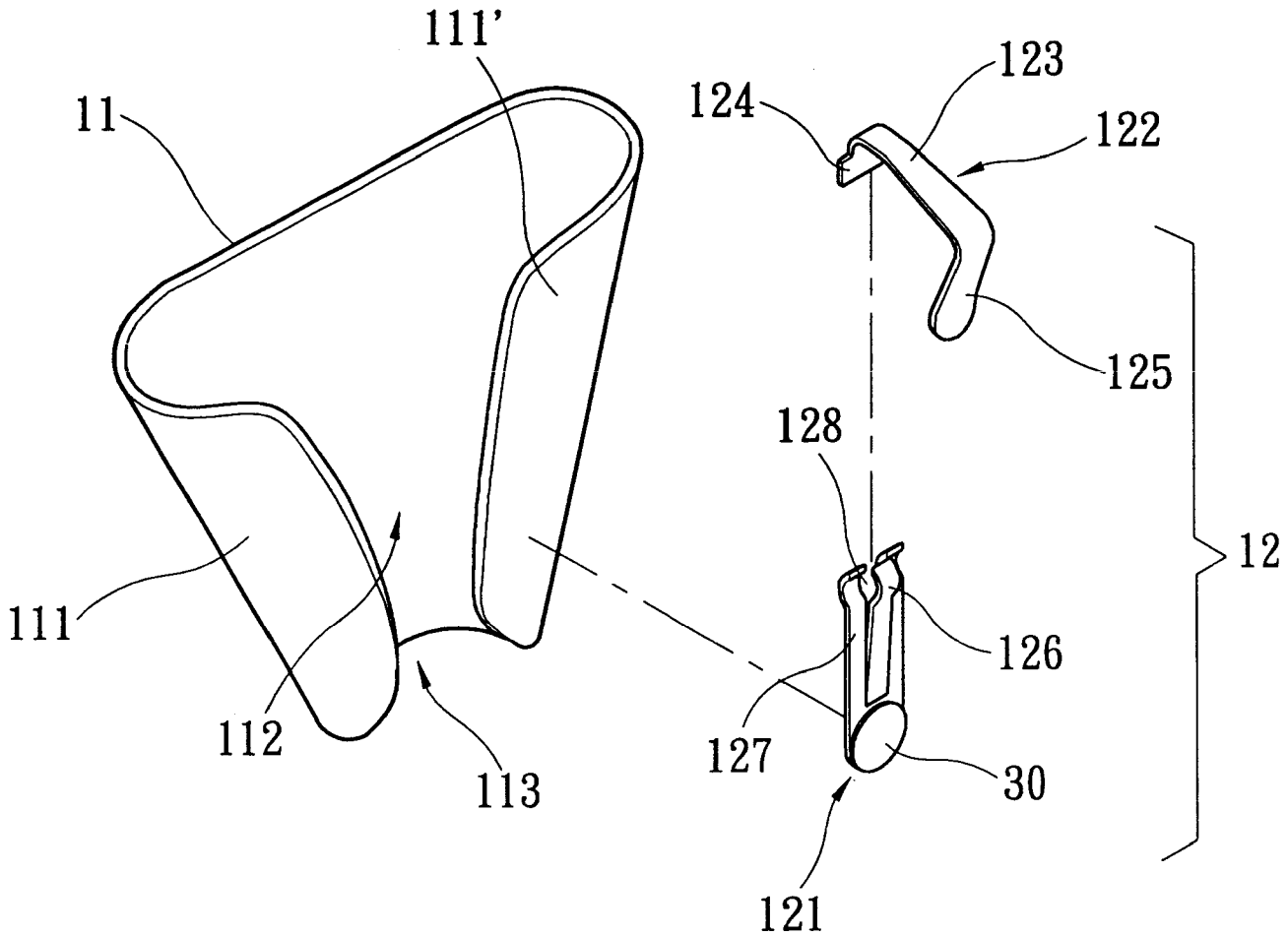
FIG. 2 is an exploded view of the tie clip shown in FIG. 1.
Figure 3:
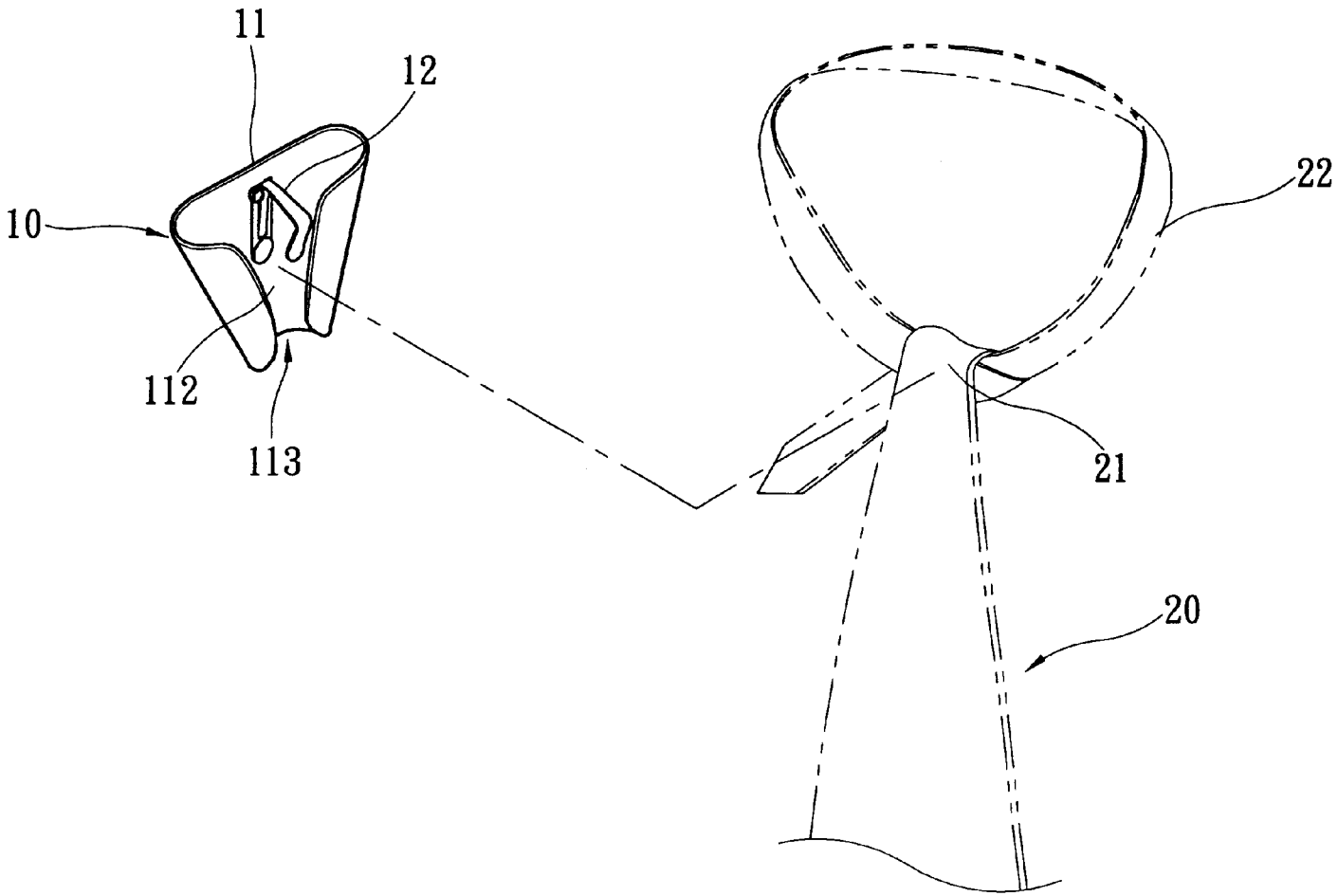
FIG. 3 shows the relationship between the tie clip and the knot in a necktie according to the present invention.

Referring to FIGS. from 1 through 3, a tie clip 10 is provided for securing a necktie 20 in shape, forming a bow at the necktie 20. The collar tie 10 is comprised of a shell 11, and a clip 12. The shell 11 is made of hard material. As an example of the present invention, the shell 11 is comprised of a hard base layer, and a soft covering layer covered on the hard base layer. The soft covering layer preferably has a design matching the color or design of the necktie. The shell 11 has a horizontal width made gradually reduced from its top side toward its bottom side, and two opposite lateral sides of the flat body thereof respectively turned backwards and then inwards, forming two back wings 111 and 111'. The back wings 111 and 111' define with the body of the shell 11 a receiving space 112 and a narrow mouth 113 at the bottom side of the receiving space 112. The clip 12 is comprised of a base frame 121 fixedly fastened to the inside wall of the shell 11 by, for example, adhesive, or a rivet 30, and a hook 122 coupled to the base frame 121. The hook 122 comprises an elongated shank 123, a hooked portion 125 extended from one end of the shank 123, and a retaining block 124 extended from the other end of the shank 123. The base frame 121 comprises an upper clamping arm 126, two lower clamping arms 127, and an actuating space 128 defined between the upper clamping arm 126 and the lower clamping arms 127. The retaining block 124 is inserted into the actuating space 128 and forced into engagement with the clamping arms 126 and 127.

Figure 4A:
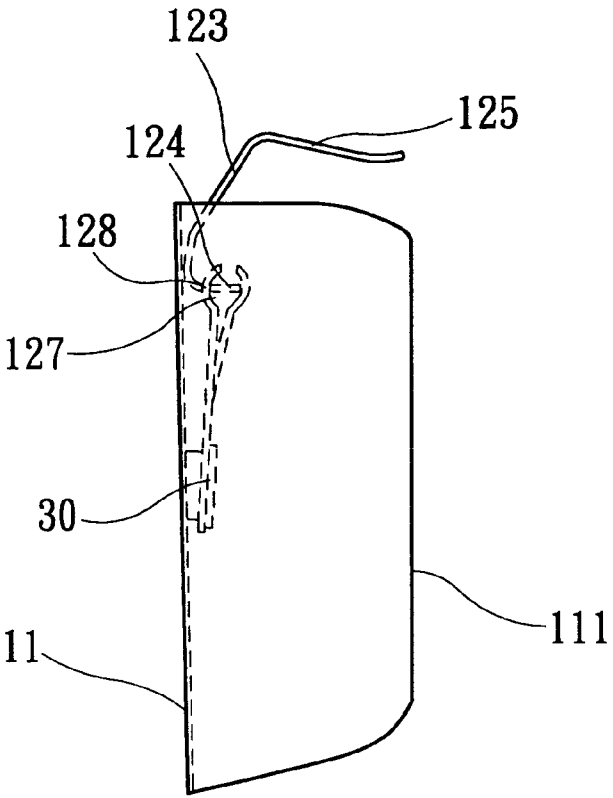
FIG. 4A is a side plain view of the present invention, showing the hook turned to the non-operative position.
Figure 4B:
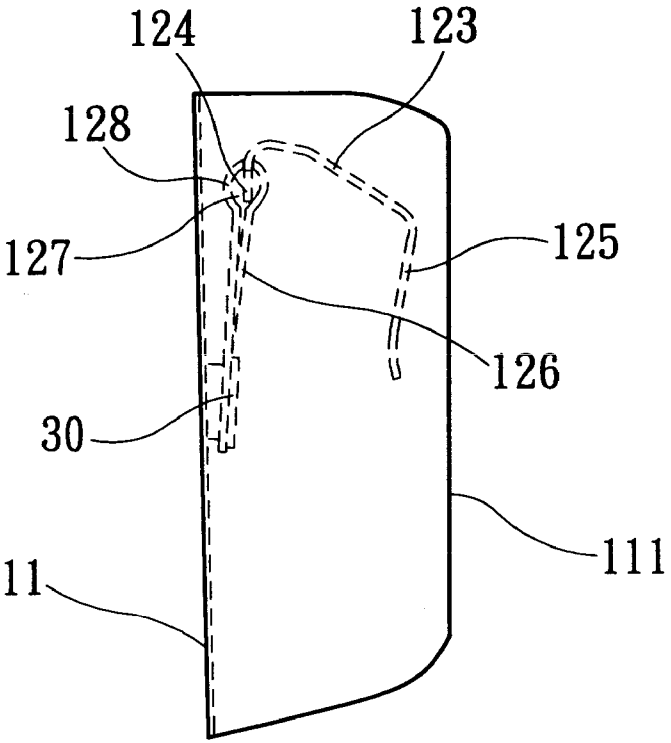
FIG. 4B is similar to FIG. 4A but showing the hook turned to the operative position.

Referring to FIGS. 4A and 4B, after installation in the base frame 121, the hook 122 can be turned between the non-operative position shown in FIG. 4A and the operative position shown in FIG. 4B.

Figure 5:
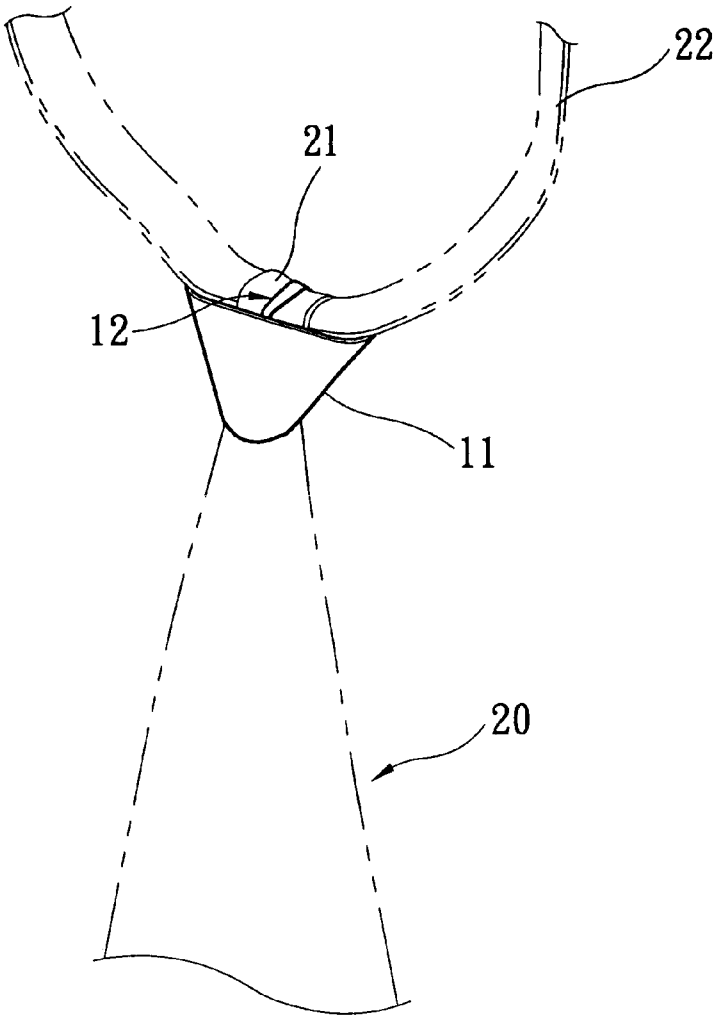
FIG. 5 shows the necktie clip fastened to the knot of the necktie according to the present invention.
Figure 6:
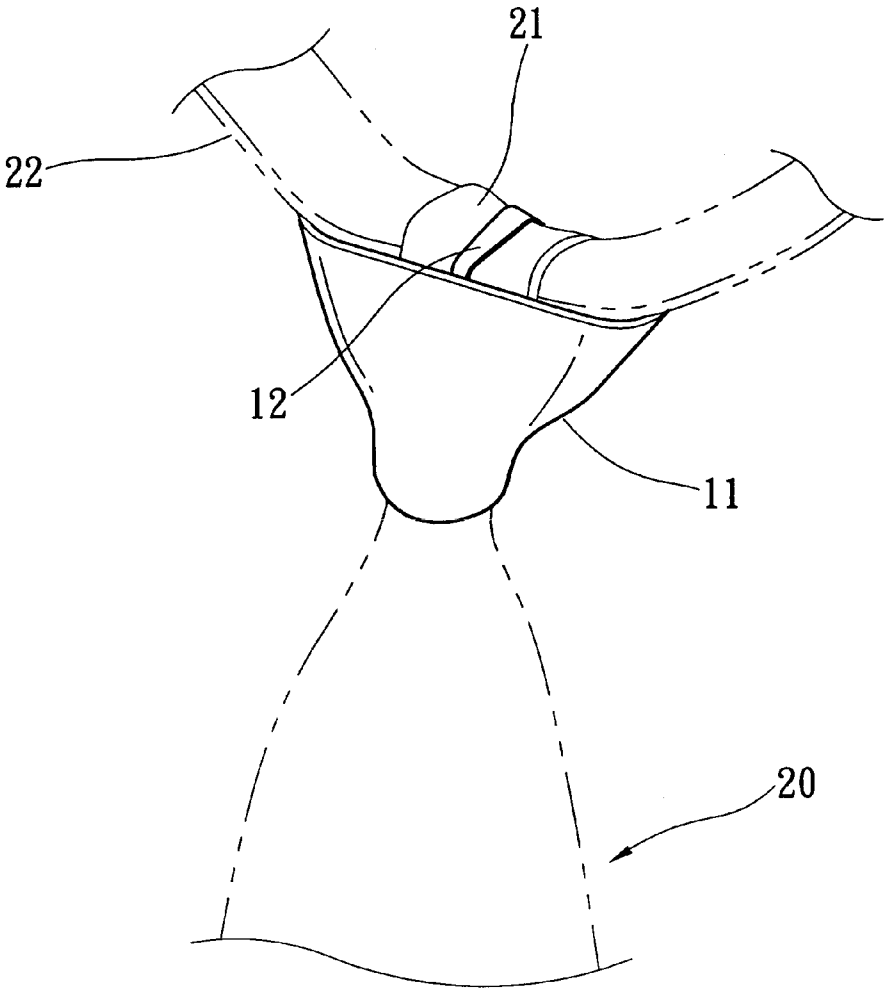
FIG. 6 shows a different shape of the shell.

Referring to FIG. 5 and FIGS. from 1 through 4 again, after tying the necktie 20 in a loose 21 with a loop 22 formed for fastening to the collar of the shirt around the user's neck, the shell 11 is attached to the front side of the knot 21 of the necktie 20, and then the hook 122 is turned downwards from the non-operative position shown in FIG. 4A to the operative position shown in FIG. 4B with the hooked portion 125 clamped on the back side of the knot 21 to secure the tie clip 10 to the knot 21 of the necktie 20 positively. Because it is not necessary to fasten up the knot 21 tightly, the necktie 20 does not wrinkle easily, and the loop 22 of the necktie 20 can easily be adjusted to fit the user's neck. The shell 11 not only decorates the necktie 20 but also protects the knot 21 of the necktie 20 against contamination. The shell 11 can have a design or color matching to the necktie 20. Alternatively, the design or color of the shell 11 can be a great contrast to the necktie 20. Further, the shell 11 can have any of a variety of shapes. FIGS. 5 and 6 show two different shapes of the shell 11.

Figure 7A:
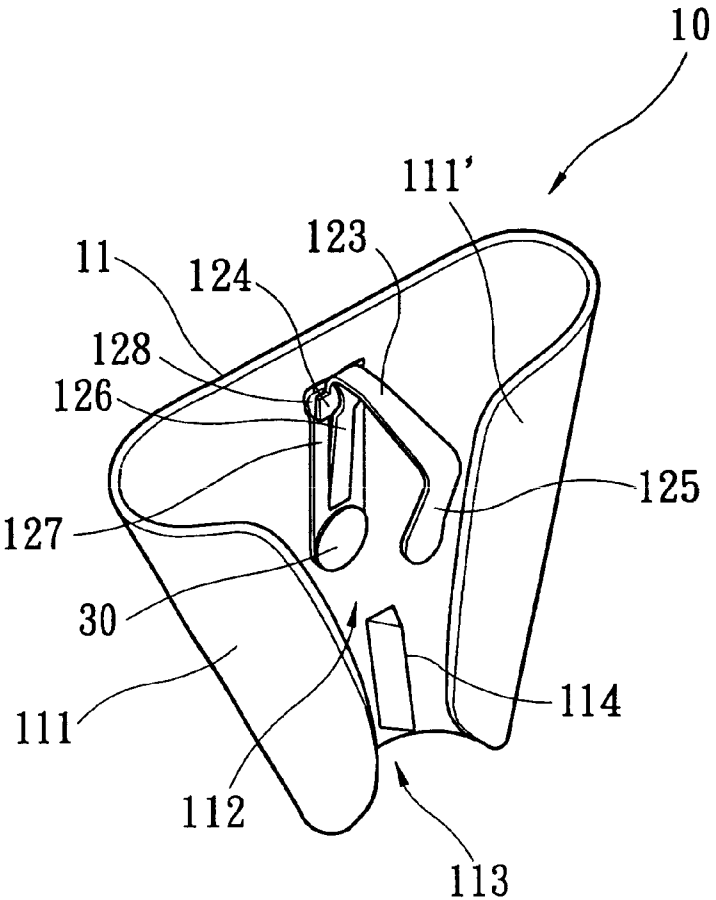
FIG. 7A is a perspective view of a tie clip according to a second embodiment of the present invention, showing a rib formed integral with the inside wall of the shell according to the present invention.
Figure 7B:
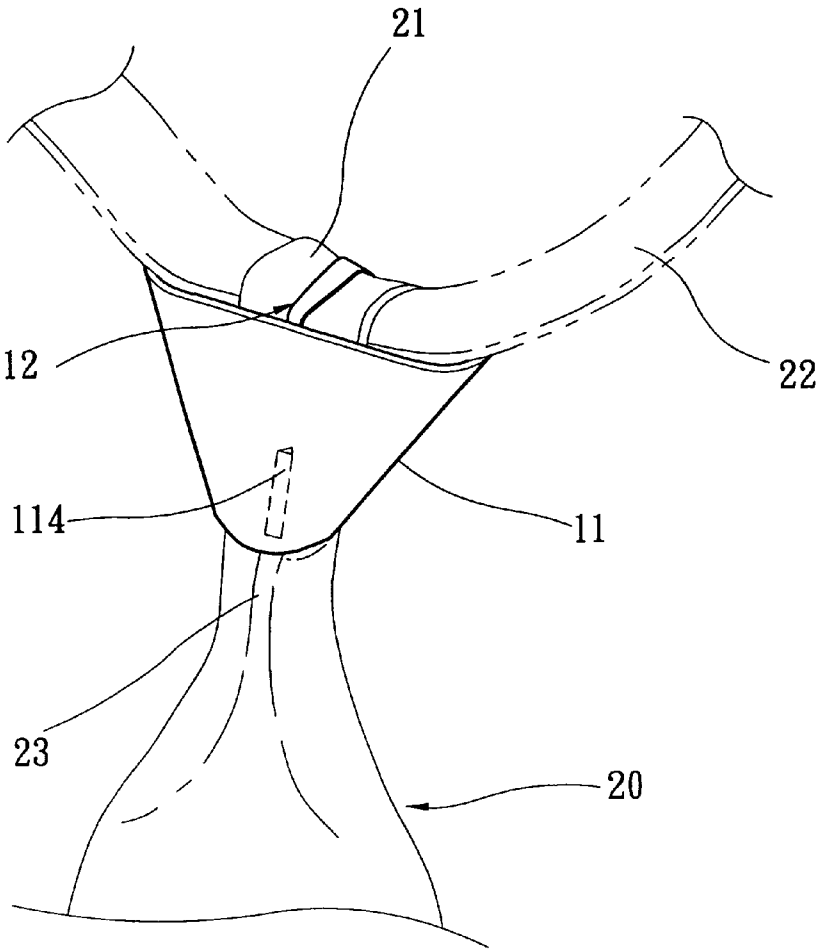
FIG. 7B shows the tie clip of the second embodiment of the present invention fastened to the knot of a necktie.

Referring to FIGS. 7 and 7A, a rib 114 is formed as an integral part of the inside wall of the shell 11 near the narrow mouth 113, which supports the necktie 20 in a particular shape, enabling the necktie to form a crease 23.

Figure 8:
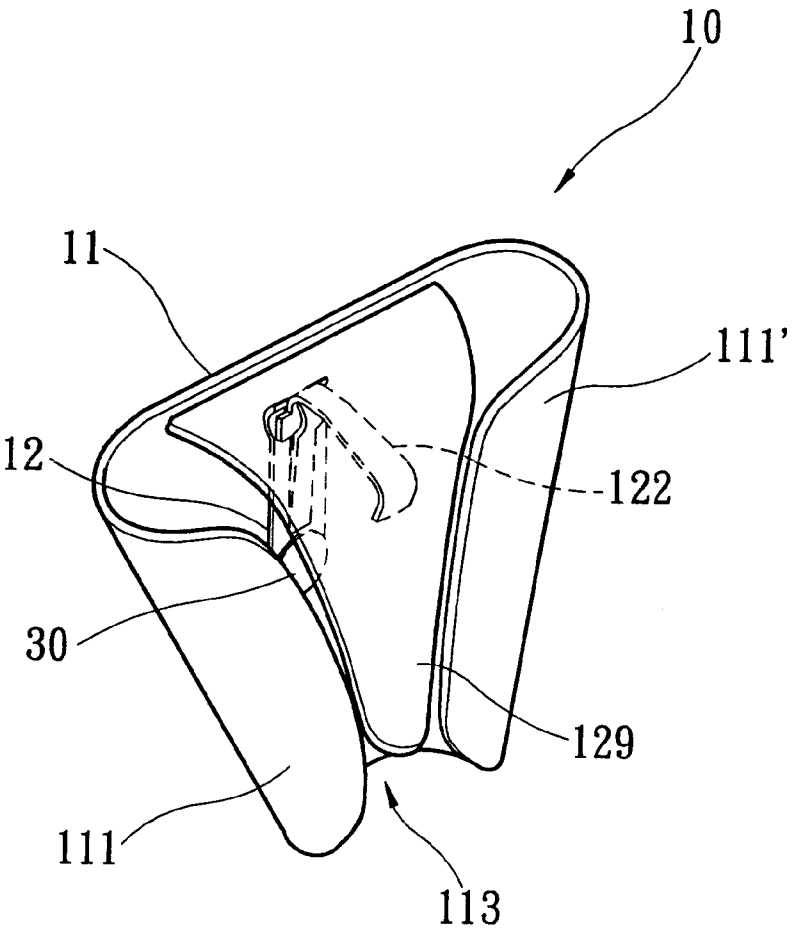
FIG. 8 is a perspective view of a tie clip according to a third embodiment of the present invention, showing a stop plate provided at the hook.

Referring to FIG. 8, a stop plate 129 is fixedly fastened to the shank and hooked portion of the hook 122. When turning the hook 122 from the non-operative position to the operative position, the stop plate 129 blocks up the gap between the wings 111 and 111', presenting the knot of the necktie from protruding over the gap.

It is to be understood that the drawings are designed for purposes of illustration only, and are not intended for use as a definition of the limits and scope of the invention disclosed.

What the invention claimed is:

1. A tie clip for fastening to a loose knot in a necktie, comprising:

a shell, said shell comprising a flat body and two symmetrical wings turned backward and inward toward each other from two opposing sides of said body, said wings being spaced from each other by a gap and defining with said body a receiving space having a narrow bottom mouth for receiving the knot of the necktie, and a clip mounted in said shell for securing said shell to the knot of the necktie, said clip comprising a base frame fastened to said body of said shell inside said receiving space, said base frame comprising an upper clamping arm and at least one lower clamping arm, and a hook coupled to said upper clamping arm and said at least one lower clamping arm of said base frame, said hook turning between a first position where said shell is attached to the knot of the necktie, and a second position where said hook is hooked on the knot of the necktie to which said shell is attached; wherein said clip further comprises a stop plate mounted on said hook to block said gap between said wings when said hook is turned to said second position.

2. The tie clip of claim 1, wherein:

said shell has a horizontal width gradually reduced from a top side thereof toward said bottom mouth.

3. The tie clip of claim 1, wherein:

said shell comprises a rib integral to said body inside said receiving space adjacent to said bottom mouth.

4. The tie clip of claim 1, wherein:

said hook comprises a shank having a first end and a second end, a retaining block is extended from said first end of said shank and coupled to said upper clamping arm and said at least one lower clamping arm of said base frame, and a hooked portion is extended from said second end of said shank.

5. The tie clip of claim 1, wherein:

said base frame is riveted to said body of said shell.

6. The tie clip of claim 1, wherein:

said base frame is adhered to said body of said shell.

* * * * *